United States Patent [19]

Leach

[11] Patent Number: 4,948,432

[45] Date of Patent: Aug. 14, 1990

[54] METHOD FOR MANUFACTURING A ROTOR FOR USE IN A PROGRESSIVE CAVITY PUMP

[75] Inventor: James K. Leach, Long Beach, Calif.

[73] Assignee: Pacific Alloy Castings, Inc., South Gate, Calif.

[21] Appl. No.: 267,384

[22] Filed: Nov. 4, 1988

[51] Int. Cl.[5] ..... C21D 5/04

[52] U.S. Cl. ..... 148/3; 148/138; 148/141; 148/2

[58] Field of Search ..... 148/321–324, 148/2, 3, 138, 141

[56] References Cited

FOREIGN PATENT DOCUMENTS 3407969 9/1985 Fed. Rep. of Germany ..... 148/3

OTHER PUBLICATIONS

Gurin et al., "Bimetallic Rotors of Centrifugal Pumps", Liteinoe Prolzvod, (10), 40–1, 1972.

Timonin et al., "Pump Rotor Castings from Cast Iron Alloyed with Cr and 2% Mo," Liteinoe Proizvod., (7), 38–9, 1972.

*Primary Examiner*—Deborah Yee

*Attorney, Agent, or Firm*—Christie, Parker & Hale

[57] ABSTRACT

A rotor for a progressive cavity pump comprises an elongated metal bar having a helical recess formed in its outer surface and progressing along the length of the rotor. The rotor is made by casting the metal bar generally in the shape of the rotor with the helical recess being formed in the outer surface of the resulting casting. The casting is made from an abrasion-resistant cast iron such as the family of cast irons available under ASTM designation A 532. The casting is then optionally subjected to an annealing step, followed by machining the outer surface of the casting to the finished shape of the rotor. The machined rotor is then heat-treated for strength and hardness. The finished rotor has a substantially longer wear life, when used to transfer abrasive fluids in a progressive cavity pump, when compared with a conventional rotor made from a chrome-plated steel alloy.

12 Claims, 1 Drawing Sheet

METHOD FOR MANUFACTURING A ROTOR FOR USE IN A PROGRESSIVE CAVITY PUMP

FIELD OF THE INVENTION

This invention relates to a process for manufacturing rotors used in progressive cavity pumps.

BACKGROUND OF THE INVENTION

Progressive cavity pumps handle a wide variety of materials, from liquids to highly viscous and abrasive materials. One such prior art pump is known as the Moyno progressive cavity pump. This pump is manufactured by Robbins & Myers, Fluids Handling Division, Springfield, Ohio. These pumps can be used to transfer the most abrasive materials. Examples are slurries containing particulate solids such as sand; municipal and industrial waste sludge; slurries of grease, paper pulp, and clay; crude oil, which contains sand, silica or diatomaceous earth; roofing materials; concrete; stucco; and so on.

Progressive cavity pumps generally include a long, narrow hard metal rotor with a single helical recess formed in its outer surface and progressing along the length of the rotor. During operation, the single helix rotor revolves eccentrically within a double helix elastomeric stator of twice of the pitch length. As the rotor turns within the stator, cavities form which progress toward the discharge end of the pump, carrying the fluids with them.

The rotor has for years been made from steel which is plated with a heavy outer layer of dense hard chrome. The stator is an elastomeric sleeve made from specially compounded elastomers and natural rubber. The steel rotor requires an initially smooth surface to avoid abrading the inside of the elastomeric stator. When the pump is used for pumping highly abrasive materials, the elastomeric stator wears out often and requires replacement. The steel alloy from which the rotor is made is not a good abrasion-resistant material, hence, the need for the abrasion-resistant chrome outer layer. Despite use of the hard chrome surface, these rotors wear out often and require replacement when the pump is used for pumping highly abrasive materials.

In the past, the helical rotors used in progressive cavity pumps have been made from steel bar stock (long, straight bars of steel). This material is reasonably inexpensive owing to its availability in large lots from steel mills. The steel bar stock is easily machined, and the rotor is formed by first machining the helical recess into the bar stock on a lathe. Since the machined steel piece is much too soft to have a suitable wear life during use in a cavity pump, the layer of hard chrome is then plated onto its outer surface. The chrome outer layer is commonly plated to a uniform layer thickness of about 0.020 inch.

Although the steel bar stock is a reasonably inexpensive starting material, the machining and chrome plating steps add to production and handling costs of manufacturing the rotor. In addition, during use, replacement costs of new rotors and the downtime costs when replacing worn rotors add to net cost of operating the pump.

SUMMARY OF THE INVENTION

The present invention is based on a recognition that changes in the material used and in the process for making the rotor can produce a novel rotor having substantially improved wear life and a lower net cost when compared with the prior art rotor described above.

Briefly, one embodiment of this invention provides a method for manufacturing a rotor for a progressive cavity pump, in which the rotor comprises an elongated metal bar having a helical recess formed in its outer surface and progressing along the length of the rotor. The method includes casting the metal bar generally in the shape of the rotor with the helical recess being formed in the outer surface of the resulting casting. The casting is made from an abrasion-resistant cast iron. In one form of the invention, the rotor is cast from any of a group of white cast irons that have been alloyed to obtain high resistance to abrasive wear. More preferably, the casting is made from an ASTM A 532 abrasion-resistant white cast iron. The resulting casting is thereafter machined by removing material from its outer surface to form the finished shape of the rotor with a smooth outer surface. Following the machining step, the rotor is heat-treated for its finished hardness. The resulting rotor has greatly improved wear life, when used to transfer abrasive fluids in a progressive cavity pump, when compared with a rotor made by conventional techniques using chrome-plated machined steel bar stock.

In some instances, the casting can be annealed to soften the casting prior to machining on a lathe. However, by selection of the proper machining equipment, the annealing step may be eliminated.

The cast white iron from which the rotor is made is much more difficult to machine than a conventional rotor made from steel bar stock. However, cutting inserts are available for machining the iron casting on a lathe into the desired finished configuration of the rotor with its critical dimensions and pitch.

The rotor can be manufactured at a reasonable cost and, combined with its improved wear life, the rotor significantly reduces the cost of operating the pump, especially for pumping abrasive materials.

These and other aspects of the invention will be more fully understood by referring to the following detailed description and the accompanying drawings.

DETAILED DESCRIPTION

Figure 1:
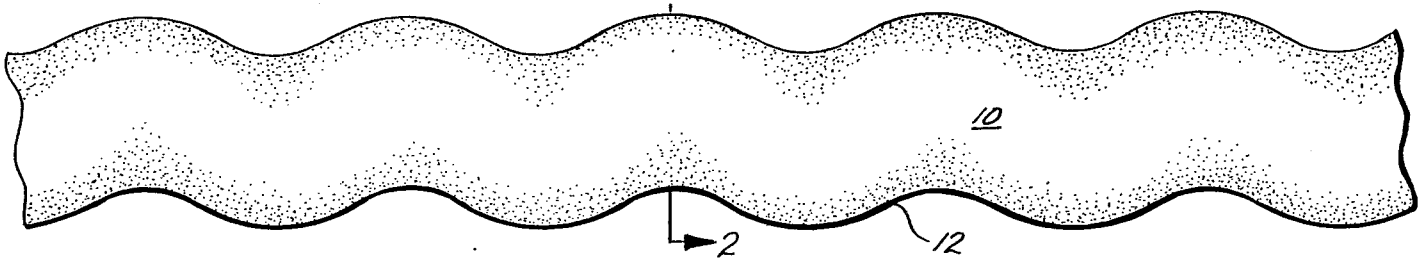
FIG. 1 is a fragmentary elevation view illustrating a rotor for a progressive cavity pump manufactured according to principles of this invention.
Figure 2:
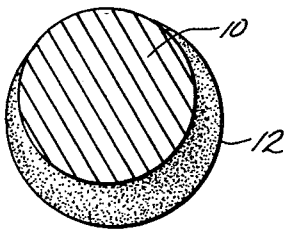
FIG. 2 is a cross-sectional view taken on line 2—2 of FIG. 1.

Referring to the drawings, this invention provides a rotor 10 for a progressive cavity pump (not shown). The rotor comprises an elongated abrasion-resistant iron alloy casting having a single helical recess 12 extending along the length of the rotor. The rotor is a unitary casting of cast iron which has been machined to its finished shape. In use, the rotor revolves eccentrically within an elastomeric double helix stator of twice the pitch length of the rotor. As the rotor turns within the stator, cavities are formed which progress toward the discharge end of the pump to carry the fluids with them. The rotor is used in progressive cavity pumps such as the type referred to in the industry as the Moyno progressive cavity pump, and these rotors are used for pumping various abrasive fluids referred to previously. Hence, there is a need for a rotor having an abrasion-resistant outer surface. The prior art approach to this problem, as described above, is to provide a hard, tough steel rotor plated with a heavy, dense layer of chrome. The rotor has, in the past, also been made from stainless steel.

The present invention provides a method for manufacturing the rotor which results in substantial improvements in abrasion resistance. The net cost of operating the pump also is reduced when the wear life of the rotor of this invention is compared with the conventional steel and chrome-plated rotor.

The rotor is manufactured by first casting an abrasion-resistant iron alloy in the shape of the helical rotor. The resulting casting preferably is oversized about one-eighth inch in outside diameter with respect to the desired finished dimensions of the single helix rotor. The pattern for the helical casting can be made by standard foundry technology. Alternatively, the rotor can be first cast in the shape of a straight bar, for example, but more machining time is then required to later shape the casting into the desired single helix configuration.

The preferred iron alloy is selected from the group of white cast irons that have been alloyed to obtain high resistance to abrasive wear, from a family of irons having a Martensitic micro-structure. A preferred family of white cast irons are the abrasion-resistant cast irons identified by the current ASTM designation A 532. These specifications for the material used in producing the rotor of this invention are incorporated herein by this reference.

The as-cast rotor has a rough outer surface. The outer surface of the casting must be finished by machining it to form a smooth outer surface. The smooth outer surface is necessary so that its contact with the inside wall of the elastomeric stator during use does not unduly abrade the stator. The critical dimensions and pitch size of the finished rotor also must be produced by the machining step. The casting is cast oversized so that the helical outer surface of the rotor can be subsequently machined down to the desired shape and dimensions of the finished rotor. Machining is controlled so that the finished machined rotor is within the required tolerances for use of the rotor in the cavity pump.

A preferred process for machining the as-cast single helix rotor is by contacting the outer surface of the casting with a cutting insert in a lathe which turns the rotor in relation to positioning of the cutting insert so that the critical shape and dimensions of the finished helical-shaped rotor are produced following the machining step. The abrasion-resistant iron casting can be difficult to machine. Therefore, in one embodiment of the invention, the casting is annealed to soften it prior to the machining step. However, it is within the purview of the invention that a properly constructed lathe with suitable cutting inserts can be developed so as to machine the helical casting into the finished configuration of the rotor without the intermediate annealing step. The as-cast rotor can be machined with a cutting insert made from borazon, for example.

The annealing step is carried out at elevated temperatures sufficient to soften the casting so that the casting can be machined more easily on the lathe. In a preferred annealing step, the casting is heated step-wise up to its annealing temperature and then the casting is cooled down step-wise, while soaking the casting for a long time at each temperature increment. Following furnace cooling, the resulting casting has a sufficient ductility to facilitate subsequent machining in a lathe.

The helical casting is positioned in the lathe relative to the cutting insert and rotational timing is controlled so that the cutting tool machines the outer surface of the casting to produce a smooth, helical outer surface of the rotor with its critical diameter and pitch from end-to-end of the finished rotor. For machining the previously annealed rotor, the preferred cutting insert is a ceramic insert capable of machining the abrasion-resistant cast-iron material. Machining is accomplished in one pass through the machine.

Following the machining step in which the casting has been machined to a finished configuration within 0.005 inch tolerance, the rotor is then heat-treated to increase the strength and hardness of the finished rotor.

The following describes a presently preferred process for carrying out the invention.

EXAMPLE

A rotor for a progressive cavity pump was produced by casting an abrasion-resistant white iron in the shape of an elongated, narrow, single helix casting. The abrasion-resistant iron was within the family of white cast irons having the ASTM designation A 532. The resulting casting was annealed by oven heating according to the following sequence. Oven temperature was ramped up to 250° F. and held for 0.1 hour; ramping at 250 ° F. per hour to 1,300° F. and soaking for 6 hours; ramping at 1,000° F. per hour up to 1,500° F. and soaking for 6 hours; ramping down at 50° F. per hour to 1,350° F. and soaking for one hour; ramping down at 5° F. per hour to 1,300° F. and soaking for 0.1 hour; and ramping at 100° F. per hour to 1,100° F. and soaking for 8 hours. The oven was then opened, and the casting was allowed to cool. The casting was then placed on a lathe utilizing a ceramic cutting insert, and the outer surface of the helical casting was machined in the lathe in a single pass through the machine to produce a rotor with a smooth outer surface having the shape and critical dimensions and pitch of a rotor suitable for use in a progressive cavity pump. The machined rotor was then rehardened by placing it in an oven and ramping to 250° F. and holding for 0.1 hour, followed by ramping at 250° F. per hour to 1,850° F. and holding for 4 hours, and then opening the oven and fan-cooling. It is estimated that the resulting rotor made according to these techniques will have an abrasion resistance about 3 to 5 times greater than a conventional rotor made from a steel alloy with a hard chrome surface.

What is claimed is:

1. A method for manufacturing a rotor for use in a progressive cavity pump, in which the rotor comprises an elongated metal bar having a helical recess formed in its outer surface and progressing along the length of the rotor, the method comprising casting the metal bar generally in the shape of the rotor with said helical recess being formed in the outer surface of the resulting casting, the casting being formed from an abrasion-resistant white cast iron meeting the specifications for ASTM designation A 532; annealing the casting; and there after machining the outer surface of the annealed casting to the finished shape of the rotor so the helical recess is formed with a smooth outer surface with dimensions and a pitch sufficient for use of the rotor in a progressive cavity pump; and thereafter heat-treating the rotor to increase the strength and hardness of the rotor for providing a finished rotor suitable for use in a progressive cavity pump.

2. The method according to claim 1 in which the casting is machined on a lathe.

3. The method according to claim 2 in which the casting is cast oversized and ten reduced to its finished critical dimensions and pitch size on the lathe.

4. The method according to claim 1 in which the annealing step comprises cooling and soaking.

5. The method according to claim 1 including machining the casting in a lathe using a ceramic cutting tool.

6. A method for manufacturing a rotor for use in a progressive cavity pump, in which the rotor comprises an elongated metal bar having a helical recess formed in its outer surface and progressing along the length of the rotor, the method comprising casting the metal bar from an abrasion-resistant white cast iron meeting the specifications for ASTM designation A 532, annealing the casting, and thereafter machining the outer surface of the casting to the finished shape of the rotor; the resulting rotor, following subsequent heat-treating to increase the strength and hardness of the rotor, providing a finished rotor suitable for use in a progressive cavity pump.

7. The method according to claim 6 in which the annealing step comprises cooling and soaking.

8. The method according to claim 6 in which the casting is machined in a lathe using a ceramic cutting tool.

9. The method according to claim 1 including annealing stepwise at temperatures up to about 1500° F.

10. The method according to claim 1 including annealing by stepwise heating and soaking up to a temperature of about 1500° F. followed by stepwise heat reduction and soaking prior to the heat-treating step.

11. The method according to claim 10 including heating to about 1850° F. during the heat-treating step.

12. A method for manufacturing a rotor for use in a progressive cavity pump, in which the rotor comprises an elongated metal bar having a helical recess formed in its outer surface and progressing along the length of the rotor at a helix dimension and pitch angle sufficient for use as a rotor in a progressive cavity pump, the method comprising casting the metal bar generally in the shape of the rotor with said helical recess being formed in the outer surface of the resulting casting, the casting being formed from an abrasion-resistant white cast iron meeting the specifications for ASTM designation A 532; and thereafter machining the outer surface of the casting in a lathe using a cutting tool made from borazon to provide the as-cast rotor as a finished rotor suitable for use in the progressive cavity pump.

* * * * *

UNITED STATES PATENT AND TRADEMARK OFFICE

CERTIFICATE OF CORRECTION

PATENT NO. : 4,948,432

DATED : August 14, 1990

INVENTOR(S) : James K. Leach

It is certified that error appears in the above-identified patent and that said Letters Patent is hereby corrected as shown below:

In the Claims:

Column 4, line 61, change "there after" to -- thereafter --.

Column 5, line 4, change "ten" to -- then --.

Signed and Sealed this

Tenth Day of March, 1992

*Attest:*

*Attesting Officer*

HARRY F. MANBECK, JR.

*Commissioner of Patents and Trademarks*